US007568770B2

(12) United States Patent
Hall et al.

(10) Patent No.: US 7,568,770 B2
(45) Date of Patent: Aug. 4, 2009

(54) SUPERHARD COMPOSITE MATERIAL BONDED TO A STEEL BODY

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 192 days.

(21) Appl. No.: 11/686,831

(22) Filed: Mar. 15, 2007

(65) Prior Publication Data

US 2007/0290547 A1 Dec. 20, 2007

Related U.S. Application Data

(63) Continuation-in-part of application No. 11/673,634, filed on Feb. 12, 2007, which is a continuation-in-part of application No. 11/668,254, filed on Jan. 29, 2007, now Pat. No. 7,353,893, which is a continuation-in-part of application No. 11/553,338, filed on Oct. 26, 2006, application No. 11/686,831, which is a continuation-in-part of application No. 11/424,806, filed on Jun. 16, 2006.

(51) Int. Cl.
*E21C 35/183* (2006.01)

(52) U.S. Cl. ..... 299/105; 299/104; 299/113

(58) Field of Classification Search ..... 299/113, 299/111, 104, 105, 107
See application file for complete search history.

(56) References Cited

U.S. PATENT DOCUMENTS 2,004,315 A 6/1935 Fean
2,124,438 A 7/1938 Struk
3,254,392 A 6/1966 Novkov
3,746,396 A 7/1973 Radd
3,800,891 A * 4/1974 White et al. ..... 175/374
3,807,804 A * 4/1974 Kniff ..... 299/113
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,268,089 A 5/1981 Spence
4,277,106 A 7/1981 Sahley (Continued)

*Primary Examiner*—John Kreck
(74) *Attorney, Agent, or Firm*—Tyson J. Wilde; Jad A. Mills

(57) ABSTRACT

In one aspect of the invention, a pick comprises a steel body comprising a formed shank attached to a first end of the body and generally extending along a central axis of the body. An impact tip is secured to a second end of the steel body and comprises a carbide substrate attached to the second end of the steel body which is bonded to a superhard material. A composite material is bonded to an outer surface of the steel body and adapted to protect the steel from wear. The composite material comprises a plurality of superhard particles held within a matrix. The matrix comprises a superhard particle concentration of 40 to 80 percent by volume.

18 Claims, 10 Drawing Sheets

U.S. PATENT DOCUMENTS 4,439,250 A 3/1984 Acharya
4,465,221 A 8/1984 Schmidt
4,484,644 A 11/1984 Cook
4,484,783 A 11/1984 Emmerich
4,489,986 A 12/1984 Dziak
4,678,237 A 7/1987 Collin
4,682,987 A 7/1987 Brady
4,684,176 A 8/1987 Den Besten
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A * 7/1990 Sionnet et al. ..... 299/105
4,951,762 A 8/1990 Lundell
5,007,685 A 4/1991 Beach
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,303,984 A 4/1994 Ojanen
5,332,348 A 7/1994 Lemelson
5,417,475 A 5/1995 Graham
5,447,208 A 9/1995 Lund
5,494,477 A * 2/1996 Flood et al. ..... 451/540
5,535,839 A 7/1996 Brady
5,542,993 A 8/1996 Rabinkin
5,653,300 A 8/1997 Lund
5,720,528 A 2/1998 Ritchey
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 * 1/2001 Heinrich et al. ..... 299/105
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 12/2002 Scott
6,517,902 B2 2/2003 Drake
6,585,326 B2 7/2003 Sollami
6,685,273 B1 2/2004 Sollami
6,702,393 B2 3/2004 Mercier
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery
6,824,225 B2 11/2004 Stiffler
6,861,137 B2 3/2005 Griffin
6,889,890 B2 5/2005 Yamazaki
6,966,611 B1 11/2005 Sollami
6,994,404 B1 2/2006 Sollami
7,204,560 B2 4/2007 Mercier
2002/0074851 A1 6/2002 Montgomery
2002/0153175 A1 10/2002 Ojanen
2002/0175555 A1 11/2002 Mercier
2003/0079565 A1 * 5/2003 Liang et al. ..... 75/240
2003/0141350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2006/0237236 A1 10/2006 Sreshta

* cited by examiner

SUPERHARD COMPOSITE MATERIAL BONDED TO A STEEL BODY

CROSS REFERENCE TO RELATED APPLICATIONS

This application is a continuation in-part of U.S. patent application Ser. No. 11/673,634 filed on Feb. 12, 2007 and entitled Thick Pointed Superhard Material. U.S. patent application Ser. No. 11/673,634 is a continuation-in-part of U.S. patent application Ser. No. 11/668,254 which was filed on Jan. 29, 2007 now U.S. Pat. No. 7,353,893 and entitled A Tool with a Large Volume of a Superhard Material. U.S. patent application Ser. No. 11/668,254 is a continuation-in-part of U.S. patent application Ser. No. 11/553,338 which was filed on Oct. 26, 2006 and was entitled Superhard Insert with an Interface. This application is also a continuation-in-part of U.S. patent application Ser. No. 11/424,806 filed on Jun. 16, 2006 and entitled An Attach Tool for Degrading Materials. All of these applications are herein incorporated by reference for all that they contain and are currently pending.

BACKGROUND OF THE INVENTION

Efficient degradation of materials is important to a variety of industries including the asphalt, mining, construction, drilling, and excavation industries. In the asphalt industry, pavement may be degraded using attack picks, and in the mining industry, attack picks may be used to break minerals and rocks. Attack picks may also be used when excavating large amounts of hard materials. In asphalt recycling, a drum supporting an array of attack picks make up a degradation assembly, which may be rotated and moved so that the attack picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

The attack picks typically have a tungsten carbide tip, which usually lasts less than a day in hard milling operations. Consequently, many efforts have been made to extend the life of these picks. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6.051,079 to Andersson et al., and U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, a pick comprises a steel body comprising a formed shank attached to a first end of the body and generally extending along a central axis of the body. An impact tip is secured to a second end of the steel body and comprises a carbide substrate attached to the second end of the steel body which is bonded to a superhard material. A composite material is bonded to an outer surface of the steel body and adapted to protect the steel from wear. The composite material comprises a plurality of diamond or cubic boron nitride particles held within a matrix. The matrix comprises a diamond or cubic boron nitride particle concentration of 40 to 80 percent by volume.

The particles may be metal bonded. These particles may be bonded by a metal selected from the group consisting of copper, silicon, indium, silver, nickel, manganese, palladium, zinc, cobalt, titanium, tin, gold, and combinations thereof. In some embodiments of the invention the particles may be resin bonded. These particles may be bonded by a resin selected from the group consisting of polyepoxides, plastics, thermosetting resins, polymers, epichlorohydrin, bisphenol A, polyimide, and combinations thereof.

The shank may be secured within a holder attached to a milling drum connected to the underside of a pavement milling machine. The shank may be secured to a trenching machine, or to a bit body adapted for subterranean drilling, horizontal drilling, and/or mining. The shank, carbide substrate and superhard material may be arranged generally coaxial.

The composite material may be secured within at least one groove formed in the outer surface of the steel body. A surface of the composite material may be recessed within the at least one groove, or it may extend beyond the groove. In some embodiments of the invention the composite material may be secured within a pattern of grooves, the pattern may be a conical helix pattern, helical pattern double helical pattern, annular ring pattern, checkered pattern, zigzag pattern, wavy pattern, segmented pattern, circle pattern, or combinations thereof.

The plurality of particles may comprise an average particle size of between 1 and 3500 microns. The outer surface of the steel body may be textured for improving the bond of the composite material to the steel body. The shank may be coated with a hard surface (which may comprise chromium, nickel, carbide, titanium, nitride, silicon, etc.) Some embodiments may comprise a composite material that is bonded to a tapered portion of the steel body.

A method of depositing a wear resistant composite material onto an outer surface of a steel pick body comprises a step of forming at least one groove in a body of the pick. A composite material is provided by mixing diamond or cubic boron nitride particles with a matrix material. The composite material is placed into the at least one groove, and the composite material are heated to a temperature above the melting temperature of the matrix material and below the melting temperature of the steel. After heating the body and composite material are cooled. The method may comprise a further step of press fitting an impact tip into the steel pick body after the body has cooled. The step of heating the composite material may comprise laser heating.

DETAILED DESCRIPTION OF THE INVENTION AND THE PREFERRED EMBODIMENT

Figure 1:
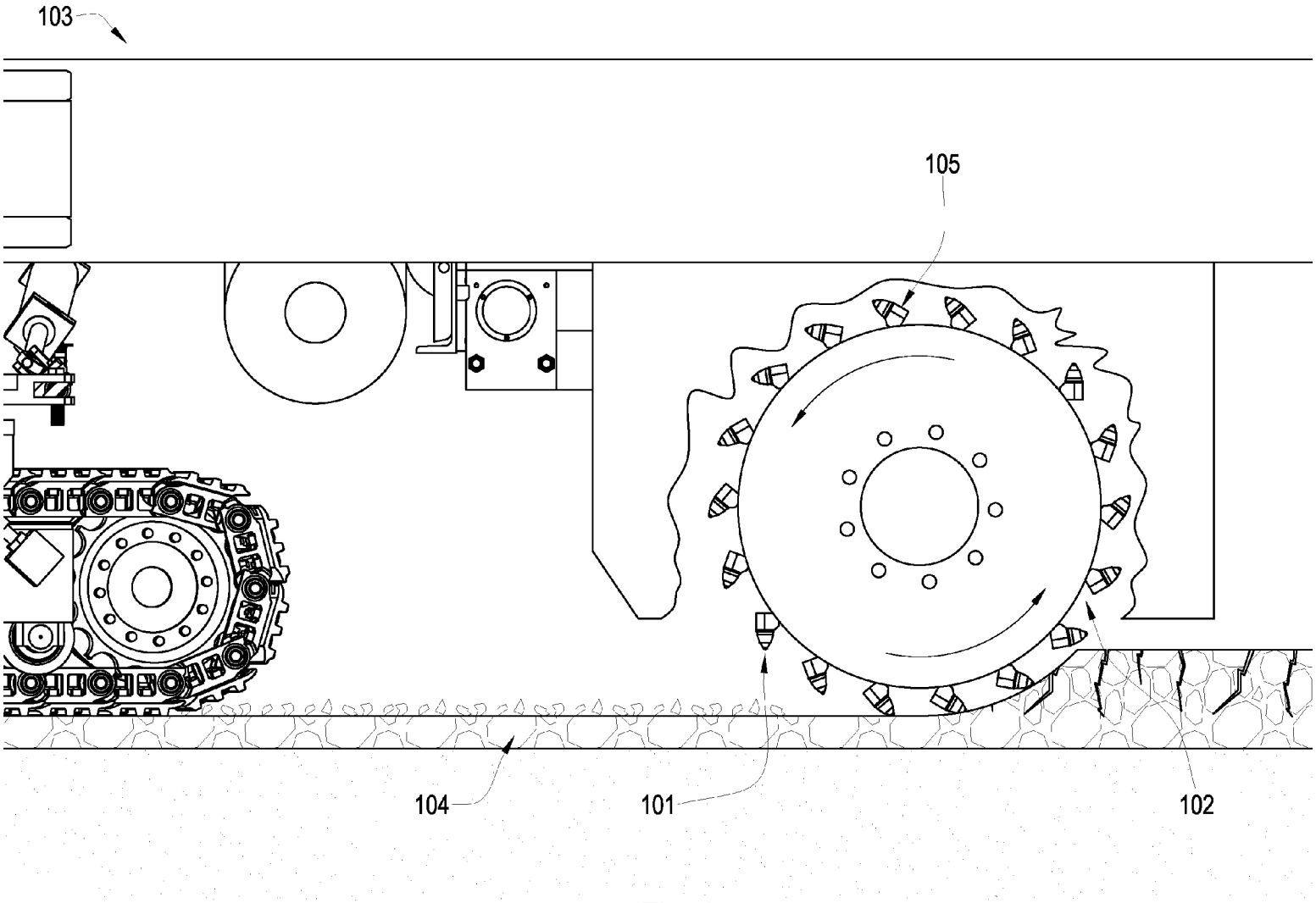
FIG. 1 is a cross-sectional diagram of an embodiment of a plurality of picks on a rotating drum attached to a motor vehicle.

FIG. 1 is a cross-sectional diagram of an embodiment of a plurality of picks 101 attached to a rotating drum 102 connected to the underside of a pavement recycling machine 103. The recycling machine 103 may be a cold planer used to degrade man-made formations such as pavement 104 prior to the placement of a new layer of pavement. Picks 101 may be attached to a drum 102 or a chain which rotates so the picks 101 engage a formation. A pick 101 combined with a holder 105 is often used in asphalt milling and mining. A holder 105 is attached to a driving mechanism, which may be a rotating drum 102, and the pick 101 is inserted into the holder 105. The holder 105 may hold the pick 101 at an angle offset from the direction of rotation, such that the pick 101 optimally engages a formation.

Figure 2:
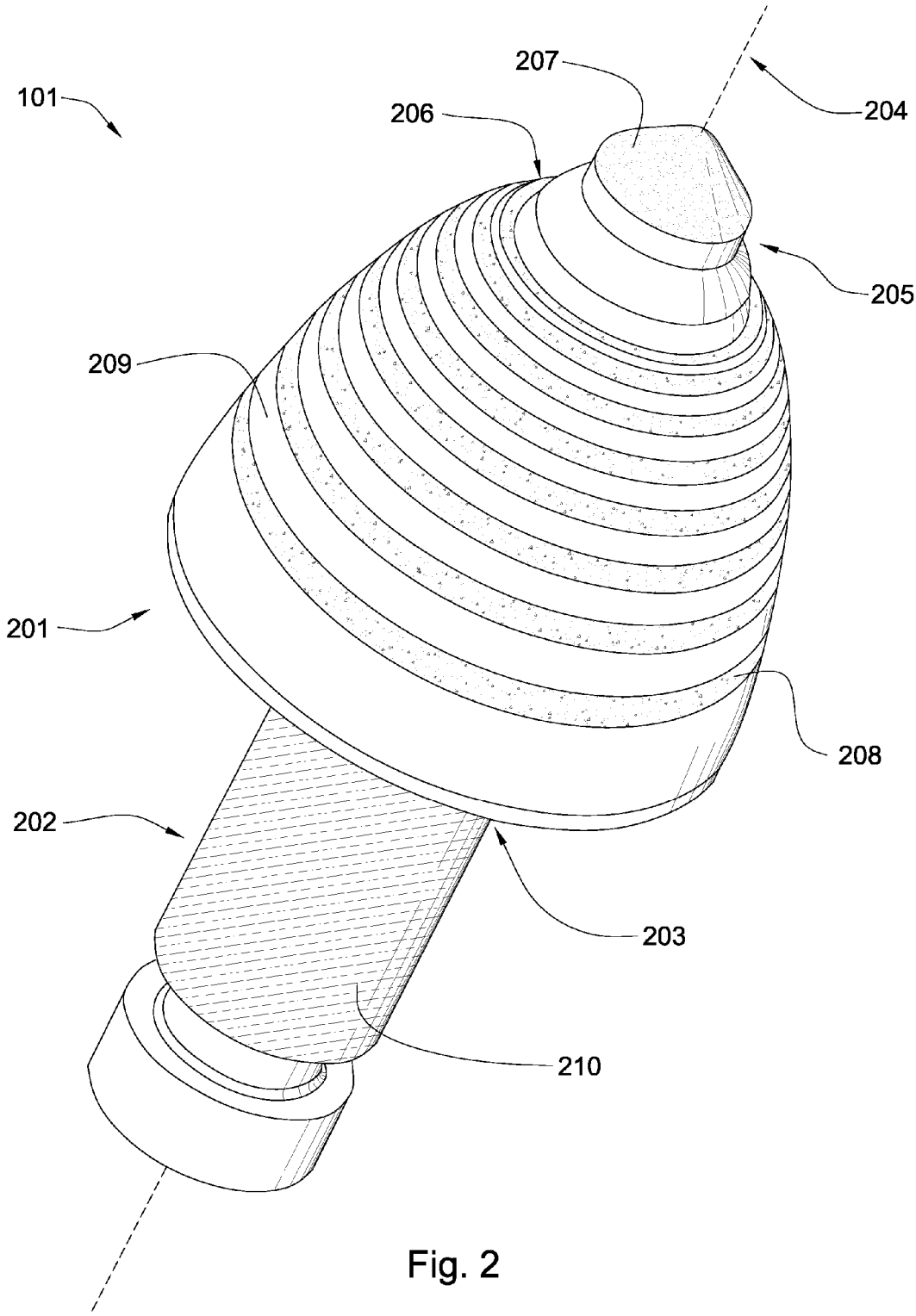
FIG. 2 is a perspective diagram of an embodiment of a pick.

FIG. 2 is a perspective diagram of an embodiment of a pick 101. The pick 101 comprises a steel body 201 that comprises a formed shank 202 attached to a first end 203 of the body 201. The shank 202 extends generally along a central axis 204 of the body 201. The steel may be 4140, ENB10, S7, A2, tool steel, hardened steel, alloy steels, PM M-4, T-15, M-4, M-2, D-7, D-2, Vertex, PM A-11, A-10, A-6, O-6, O-1, H-13, or combinations thereof. An impact tip 205 is secured to a second end—of the body 201, and comprises a carbide substrate. The carbide substrate is attached to the second end 206 and is bonded to a superhard material 207. Attack picks 101 often rotate within their holders 105 upon impact which allows wear to occur evenly around the tool 101. The impact tip 205 may be angled such so that it cause the pick 101 to rotate within the bore of the holder 105. The impact tip 205 may comprise a generally circular shape, a generally annular shape, a generally spherical shape, a generally pyramidal shape, a generally conical shape, a generally arcuate shape, a generally asymmetric shape, or combinations thereof.

The shank 202 may be coated with a hard surface 210. The hard surface 210 may comprise a cemented metal carbide, chromium, manganese, nickel, titanium, silicon, hard surfacing, diamond, cubic boron nitride, polycrystalline diamond, diamond impregnated carbide, diamond impregnated matrix, silicon bonded diamond, deposited diamond, aluminum oxide, zircon, silicon carbide, whisker reinforced ceramics, nitride, stellite, or combinations thereof. The hard surface 210 may be bonded to the shank 202 through the processes of electroplating, cladding, electroless plating, thermal spraying, annealing, hard facing, applying high pressure, hot dipping, brazing, or combinations thereof. The surface 210 may comprise a thickness of 0.0001 to 0.200 inches. The surface 210 may be polished.

A composite material 208 is bonded to an outer surface 209 of the body 201 and protects the steel from wear. The composite material 208 maybe bonded to a tapered portion, stepped portion, or cylindrical portion of the body 201. The composite material 208 comprises a plurality of diamond, diamond-like and/or cubic boron nitride particles held within a matrix. The matrix comprises 40 to 80 percent diamond or cubic boron nitride particles by volume. It is believed that too low of a particle concentration causes the matrix around the particles to wear away thereby causing more of the particle to be exposed and thereby fall out, which in turn exposes new particles. Preferably there is a high enough concentration of the particles that the particles protect the matrix from wearing away and effectively form a super wear resistant composite material. The particles may comprise an average particle size of between 1 and 3500 microns. More preferably, the average particle size is less than 50 microns. Most preferably, the average particle size is less than 10 microns. It is believed the smaller the particle size the greater wear resistance that the composite material will have and thereby protect the steel from wear.

The matrix material may be a metal or a resin bonded. Metal bonded particles may be bonded by a matrix comprising of silver, copper, silicon, indium, nickel, manganese, palladium, zinc, cobalt, titanium, tin, gold, boron, chromium, germanium, aluminum, iron, gallium, vanadium, phosphorus, molybdenum, platinum, alloys, mixtures and combinations thereof. In some embodiments, the superhard particles may be coated with a metal, such as titanium, niobium, cobalt, tantalum, nickel, iron or combinations thereof, which may adhere better to the particles to the matrix. The particles may be bonded by melting the matrix material to a temperature sufficient to melt the matrix but still below the melting temperature of the steel. A metal bonded matrix may comprise a melting temperature from 700 to 1200 degrees Celsius.

Preferably, the impact tip, which comprises a superhard material bonded to a carbide substrate, is brazed to a carbide bolster which is press fit into a bore formed in the steel body. In other embodiments, the carbide bolster may be brazed to the steel body. In embodiments, where the bolster is brazed to the steel body active cooling during heating of the matrix may be critical, since the heat from brazing may leave some residual stress in the bond between the carbide substrate and the superhard material. In some embodiments, the bolster may be brazed to the steel body at the same time that the composite material is being bonded to the steel body. A heat sink may be placed over at least part of the superhard material 207 or other part of the attack pick during the heating stage. Water or other fluid may be circulated around the heat sink to remove the heat. The heat sink may also be used to apply a force on the pick 101 to hold it together while brazing.

In some embodiments of the invention the composite material 208 may comprise resin bonded particles. These particles may be bonded by a resin selected from the group consisting of polyepoxides, plastics, thermosetting resins, epoxies, polymers, epichlorohydrin, bisphenol A, polyimide, and combinations thereof. The resin may be hardened by adding an activating compound, thereby inducing a chemical reaction, such as a polymerization reaction.

Figure 3:
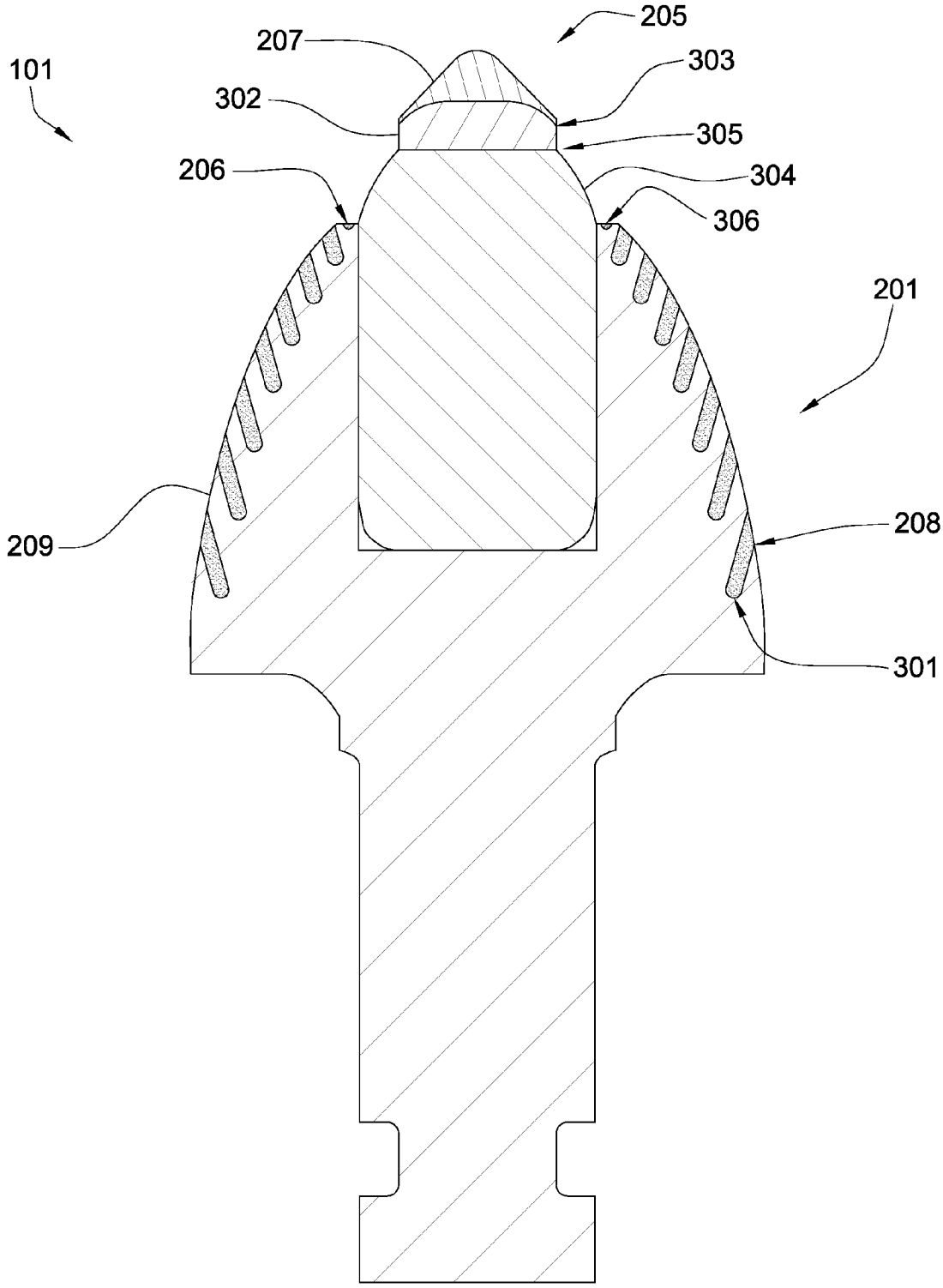
FIG. 3 is a cross-sectional diagram of an embodiment of a pick.

FIG. 3 is a cross-sectional diagram of a pick 101 consistent with the present invention. A plurality of annular grooves 301 have been formed in the outer surface 209 of the body 201. These annular grooves 301 have then been filled with composite material 208. A shallow annular groove 306 may be formed in the second end 206 of the body 201. This groove 306 may also be filled with composite material 208 so that an exposed surface of the body 201 on the second end 206 between the bolster 304 and the deeper annular grooves 301. An interface 303 between the carbide substrate 302 and the superhard material 207 may be non-planar or planar. The superhard material 207 may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof. The superhard material 207 may be a polycrystalline structure with an average grain size of 10 to 100 microns. The cemented metal carbide substrate 302 may comprise a 1 to 40 percent concentration of cobalt by weight, preferably 5 to 10 percent.

The superhard material 207 may be at least 4,000 HK and in some embodiments it may be 1 to 20000 microns thick. In embodiments, where the superhard material is a ceramic, the material may comprise a region, preferably near its surface, that is free of binder material. Infiltrated diamond is typically made by sintering the superhard material 207 adjacent a cemented metal carbide substrate 302 and allowing a metal (such as cobalt) to infiltrate into the superhard material. In some embodiments the impact tip 205 may be connected to the second end 206 of the body 201 by a carbide bolster 304. In some embodiments the tip 205 and the bolster 304 may be originally formed as a single unit. Typically the impact tip 205 is brazed to the bolster 304 at a planar interface 305.

The superhard material 208 may be bonded to the carbide substrate 302 through a high temperature high pressure process. During high temperature high pressure (HTHP) processing, some of the cobalt may infiltrate into the superhard material such that the substrate 302 comprises a slightly lower cobalt concentration than before the HTHP process. The superhard material 207 may preferably comprise a 1 to 5 percent cobalt concentration by weight after the cobalt or other binder infiltrates the superhard material 207. The superhard material 207 may also comprise a 1 to 5 percent concentration of tantalum by weight. Other binders that may be used with the present invention include iron, cobalt, nickel, silicon, carbonates, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof. In some embodiments, the binder is added directly to the superhard material's mixture before the HTHP processing and do not rely on the binder migrating from the substrate into the mixture during the HTHP processing.

The superhard material 207 may comprise a substantially pointed geometry with a sharp apex comprising a radius of 0.050 to 200 inches. In some embodiments, the radius is 0.900 to 0.110 inches. It is believed that the apex may be adapted to distribute impact forces, which may help to prevent the superhard material 207 from chipping or breaking. The superhard material 207 may comprise a thickness of 0.100 to 0.500 inches from the apex to the interface with the substrate 302, preferably from 0.125 to 0.275 inches. The superhard material 207 and the substrate 302 may comprise a total thickness of 0.200 to 0.700 inches from the apex to the base of the substrate. The sharp apex may allow the high impact resistant pick 101 to more easily cleave asphalt, rock, or other formations.

Figure 4:
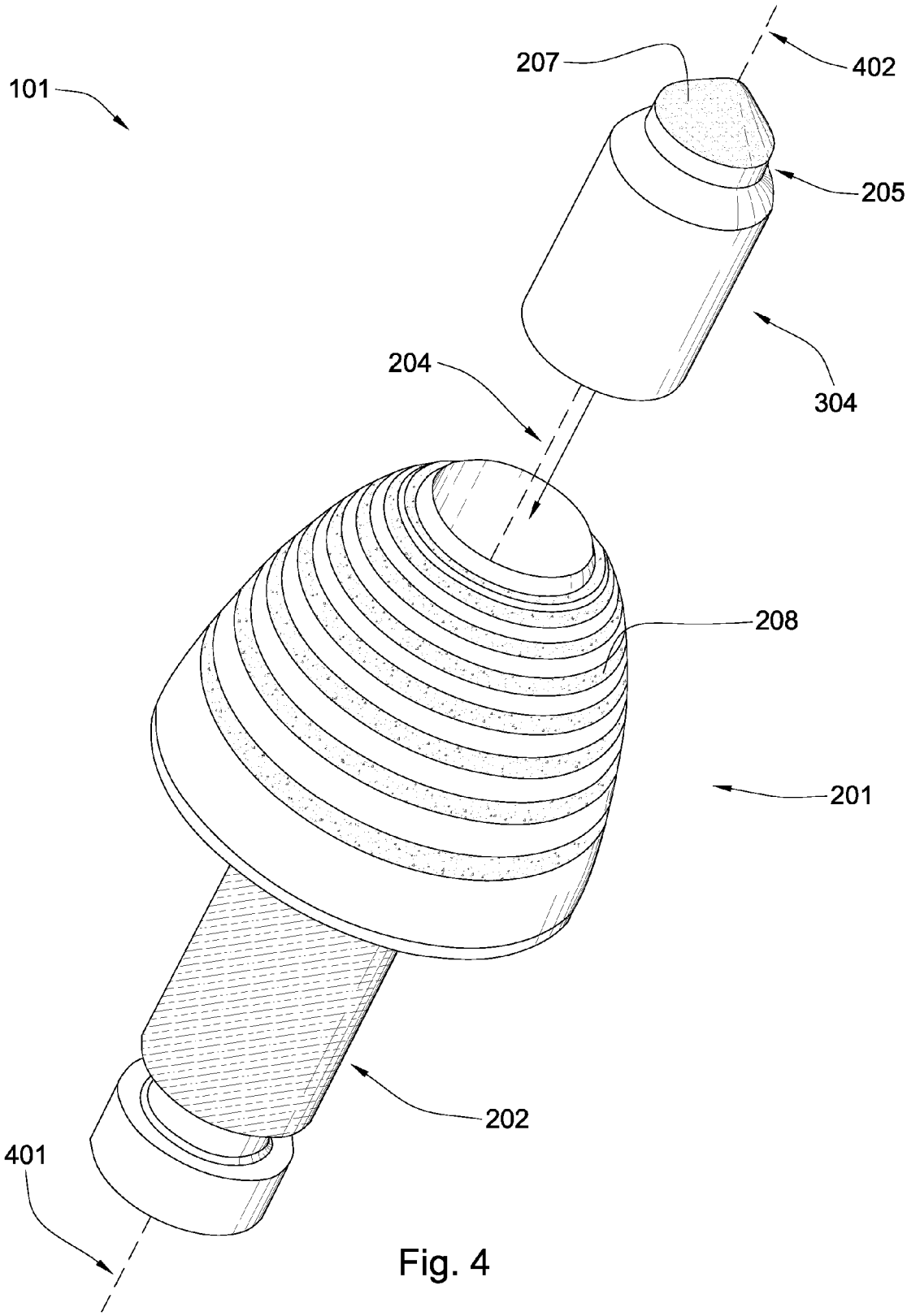
FIG. 4 is an exploded diagram of an embodiment of a pick.

Referring now to FIG. 4, an exploded diagram of a pick 101 is shown in which the impact tip 205 and the carbide bolster 304 are being press fit into the steel body 201. In this embodiment the steel body 201 has already been bonded to the composite material 208. In some embodiments of the invention the tip 205 and/or bolster 304 may be press fit into the body 201 before the composite material 208 is bonded to the body 201. However, it is believed that heating the impact tip 205 after the tip 205 is already bonded to the superhard material 207 may induce residual stress in the superhard material 207 due to different thermal expansions in the superhard material and the carbide substrate. Press fitting the tip 205 into a body 201 that is already bonded to the composite material 208 may help to avoid this problem. The shank 202 may comprise a central axis 401 that is generally coaxial with the central axis 204 of the steel body 201. A central axis 402 of the impact tip 205 may be generally coaxial with the central axes 204, 401 of the body 201 and shank 202.

Figure 5:
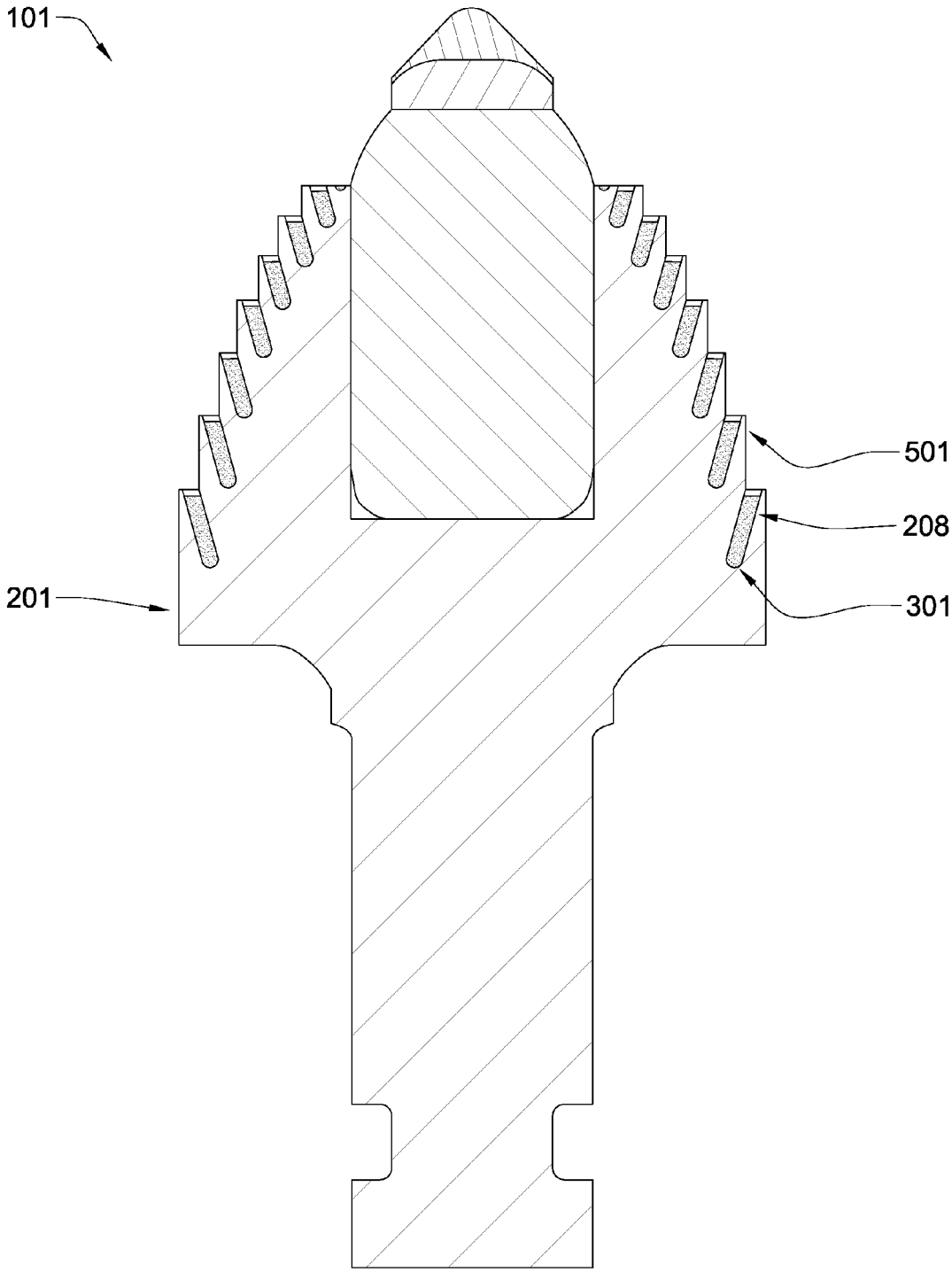
FIG. 5 is a cross-sectional diagram of another embodiment of a pick.

In FIG. 5, an embodiment of a pick 101 is disclosed in which the composite material 208 is recessed within a plurality of annular grooves 301 that are formed in the steel body 201. When bonding the particles to each other and to the body 201, technicians may heat the body 201, the particles, and the matrix material to a temperature above the melting point of the matrix material. The matrix material may then bond together the particles to form a composite material 208, which also may bond to the body 201. Composite material 208 that is recessed within the annular grooves 301 may be easier to deposit and control during the process of melting the matrix material. It is believed that after the composite material 208 has bonded to the steel body 201 that during operation of the pick 101 the softer protrusions 501 of the steel body 201 will wear down until the composite material 208 is further exposed, thereby presenting an effective wear resistant surface to prevent further degradation of the steel body 201. This structure may also create pockets in which formation aggregate may pack, thereby protecting the surface 209 beneath the pockets. In some embodiments, the composite material is formed in rings, segments, rods, beads, or other forms separately and then press fit into the grooves formed in the steel body.

Figure 6:
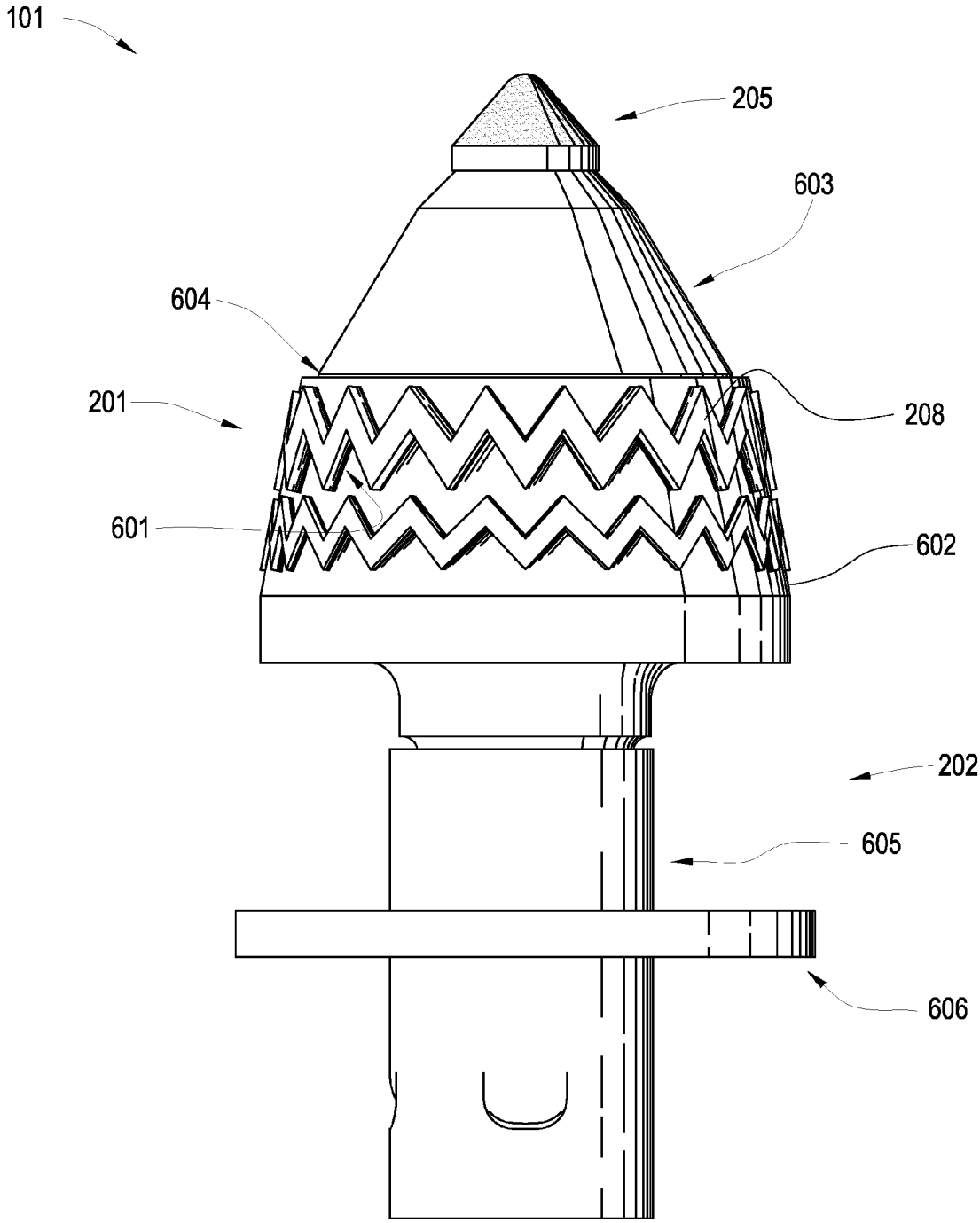
FIG. 6 is a perspective diagram of another embodiment of a pick.

Referring now to FIG. 6 an embodiment of a pick 101 is disclosed in which the composite material 208 is disposed in a zigzag pattern. In the embodiment of FIG. 6, the composite material is not secured within a groove, but is attached directly to the outer surface of the steel body. It is believed that by extending beyond the groove 601 and thereby beyond a surface 602 of the steel body 201, that the composite material 208 may better protect the body 201 from abrasive contact with the formation. FIG. 6 also discloses a pick 101 in which the impact tip 205 is brazed to a carbide bolster 603, which is brazed to the steel body 201 at a planar interface 604. A protective spring sleeve 605 may be disposed around the shank 202 both for protection and to allow the high impact resistant pick 101 to be press fit into a holder 105 (see FIG. 1) while still being able to rotate. A washer 606 may also be disposed around the shank 202 such that when the pick 101 is inserted into the holder 105, the washer 606 protects an upper surface of the holder 105 and also facilitates rotation of the pick 101.

Figure 7:
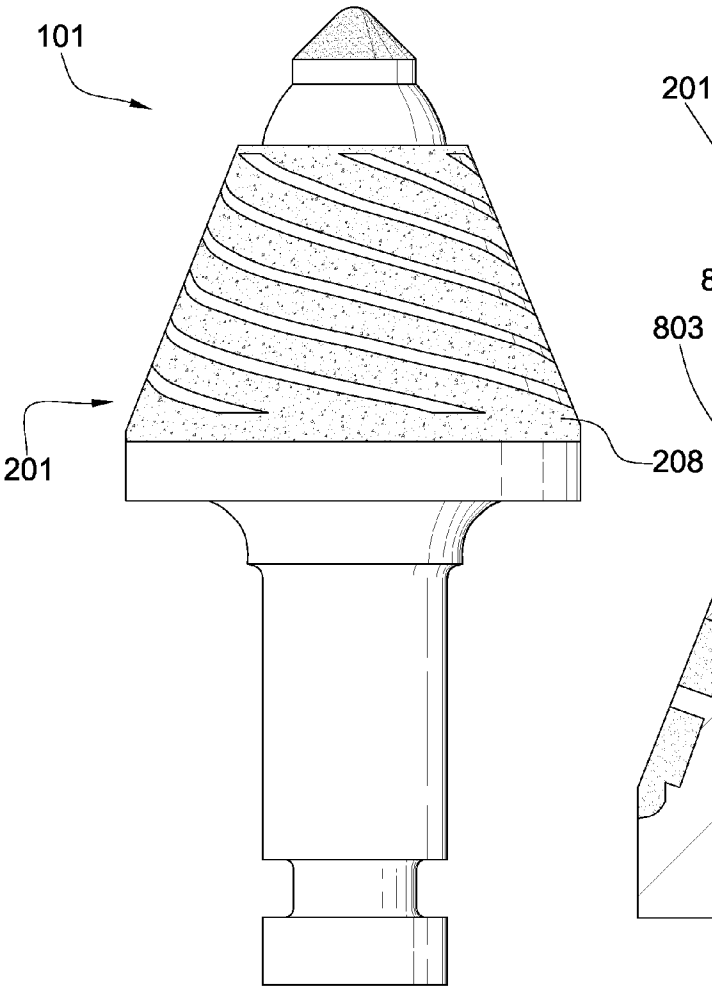
FIG. 7 is a perspective diagram of another embodiment of a pick.

FIG. 7 discloses an embodiment of a pick 101 in which the composite material 208 is secured within a conical helical groove pattern. It is believed that a conical helical groove pattern may help the composite material 208 to bind to the steel body 201 by providing a large surface area for binding while reducing the depth of the groove. In various embodiments of the invention the composite material 208 may be secured by other specific pattern of grooves, including conical helix patterns, helical patterns, double helical patterns, annular ring patterns, checkered patterns, zigzag patterns, wavy patterns, segmented patterns, circle patterns, or combinations thereof. Specific groove patterns may provide wear protection in areas of the pick 101 that are most advantageous to particular applications. It is believed that some of the groove patterns such as helical patterns may help the pick to rotate within the holder and thereby allow for even wearing along the outer diameter of the steel body.

Figure 8:
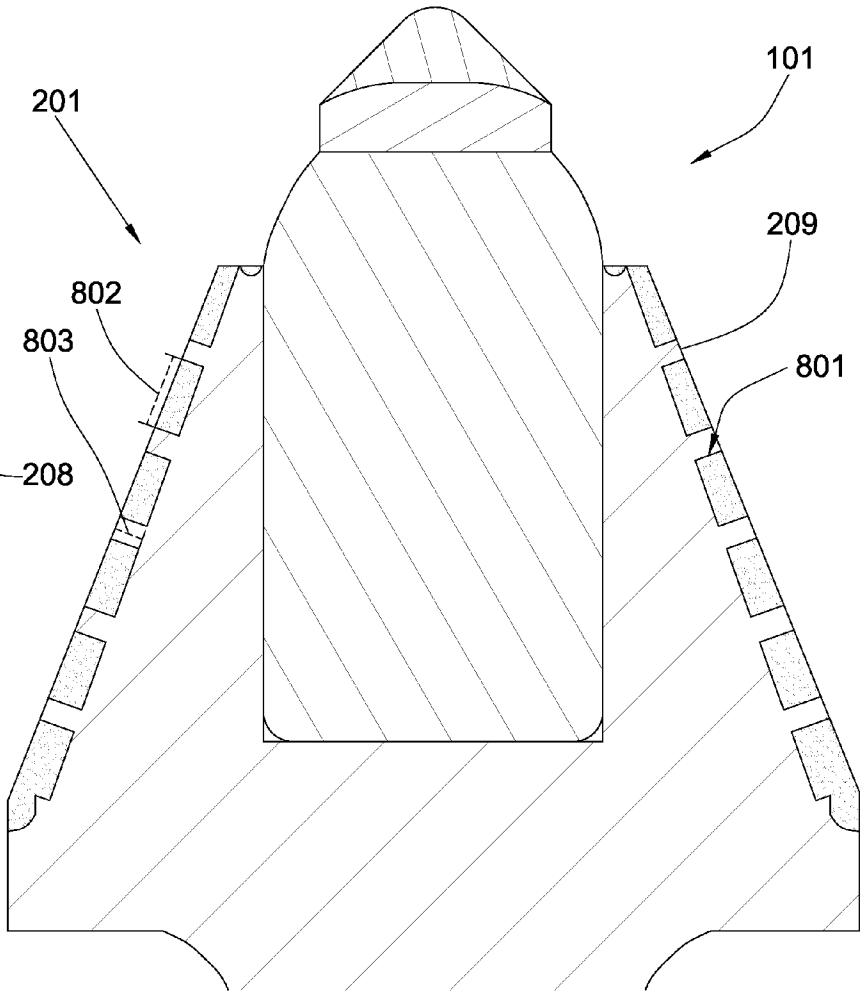
FIG. 8 is a cross-sectional diagram of another embodiment of a pick.

Referring now to FIG. 8, a cross sectional diagram discloses an embodiment of a pick 101 in which thin, wide grooves 801 have been formed in the surface 209 of the steel body 201. These grooves comprise a width 802 and a height 803, wherein the width 802 is greater than the height 803. In some embodiments of the invention the width 802 may be lesser than the height 803, or the ratio of width 802 to height 803 may vary from groove to groove on a single pick 101.

Figure 9:
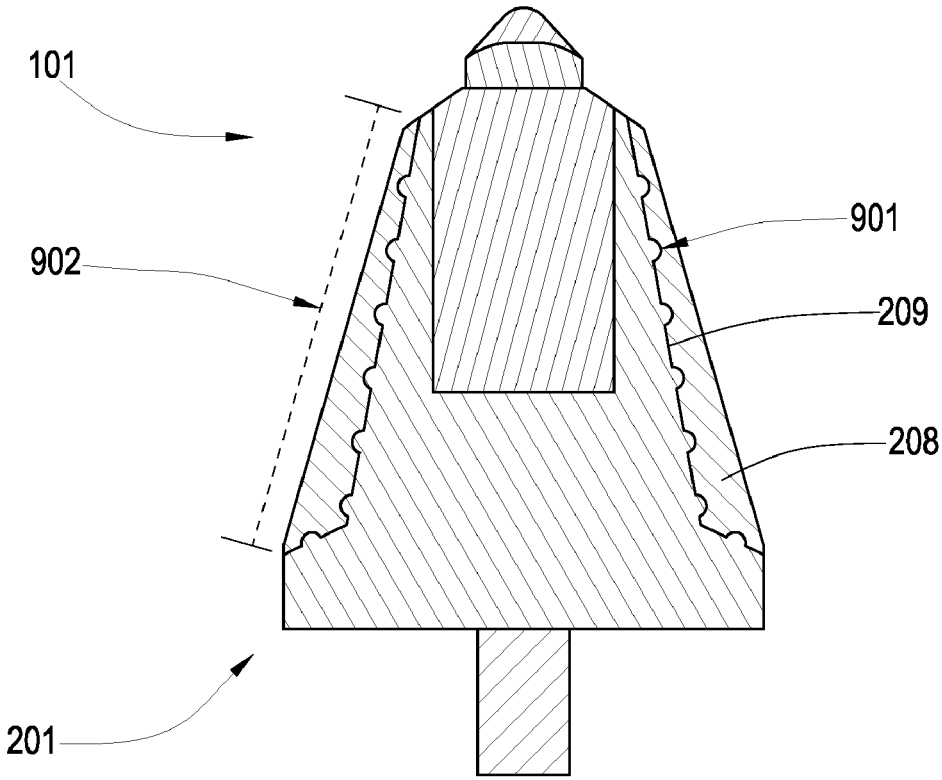
FIG. 9 is a cross-sectional diagram of an embodiment of a pick.

FIG. 9 discloses an embodiment of a pick 101 in which the outer surface 209 of the pick 101 is textured. In the present embodiment a plurality of spherical protrusions 901 of the outer surface 209 provide texture to the body 201. It is believed that this texture may help to increase the bond surface area between the body 201 and the composite material 208, thereby helping to strengthen the bond. The present diagram also discloses an embodiment where the composite material 208 is bonded to the outer surface 209 as one continuous deposit along a wear-protected length 902 of the pick 101.

Figure 10:
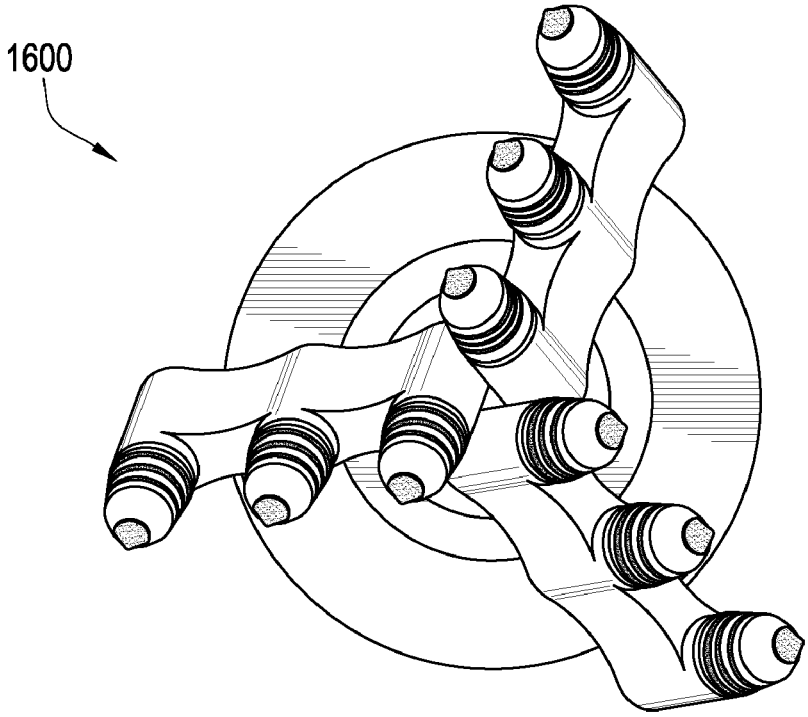
FIG. 10 is a perspective diagram of an embodiment of a mining bit.

The attack pick 101 may be used in various applications. The pick 101 may be disposed in an asphalt milling machine 103, as in the embodiment of FIG. 1. FIG. 10 discloses a bit 1600 that may be incorporated with the present invention.

Figure 11:
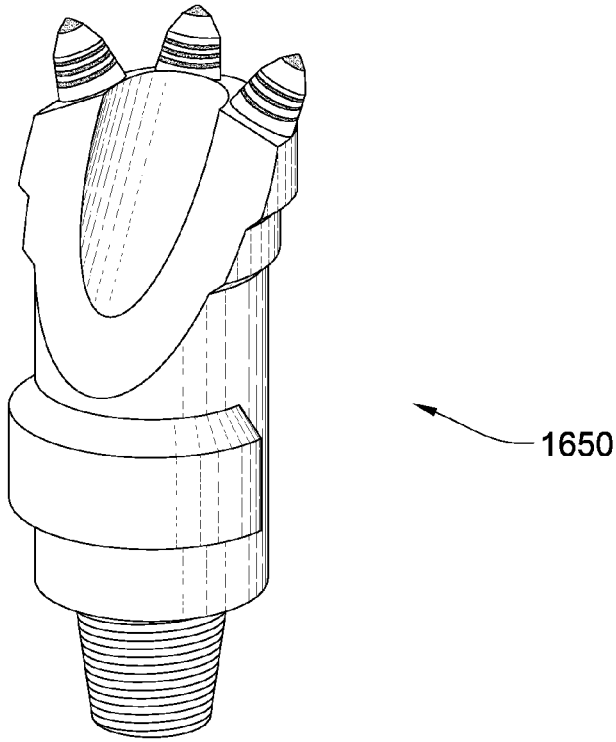
FIG. 11 is an orthogonal diagram of an embodiment of a drill bit.
Figure 12:
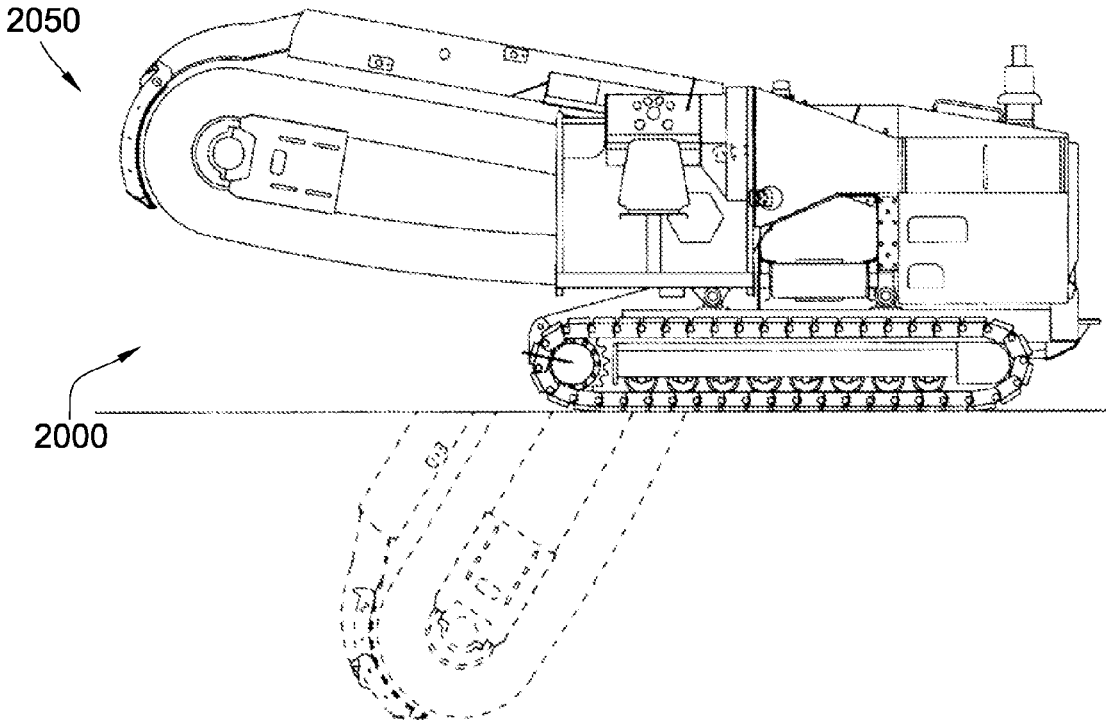
FIG. 12 is a perspective diagram of an embodiment of a trenching machine

FIG. 11 discloses a drill bit 1650 typically used in subterranean, horizontal drilling that may be consistent with the present invention. The pick 101 may be used in a trenching machine 2000, as disclosed in FIG. 12. The picks 101 may be placed on a chain that rotates around an arm 2050. Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources. Various mills that may incorporate the composite material include mulchers, vertical shaft mills, hammermills, cone crushers, chisels, jaw crushers, or combinations thereof. Percussion bits, roller cone bits, and shear bits used in the oil and gas industry may also incorporate the composite material.

Figure 13:
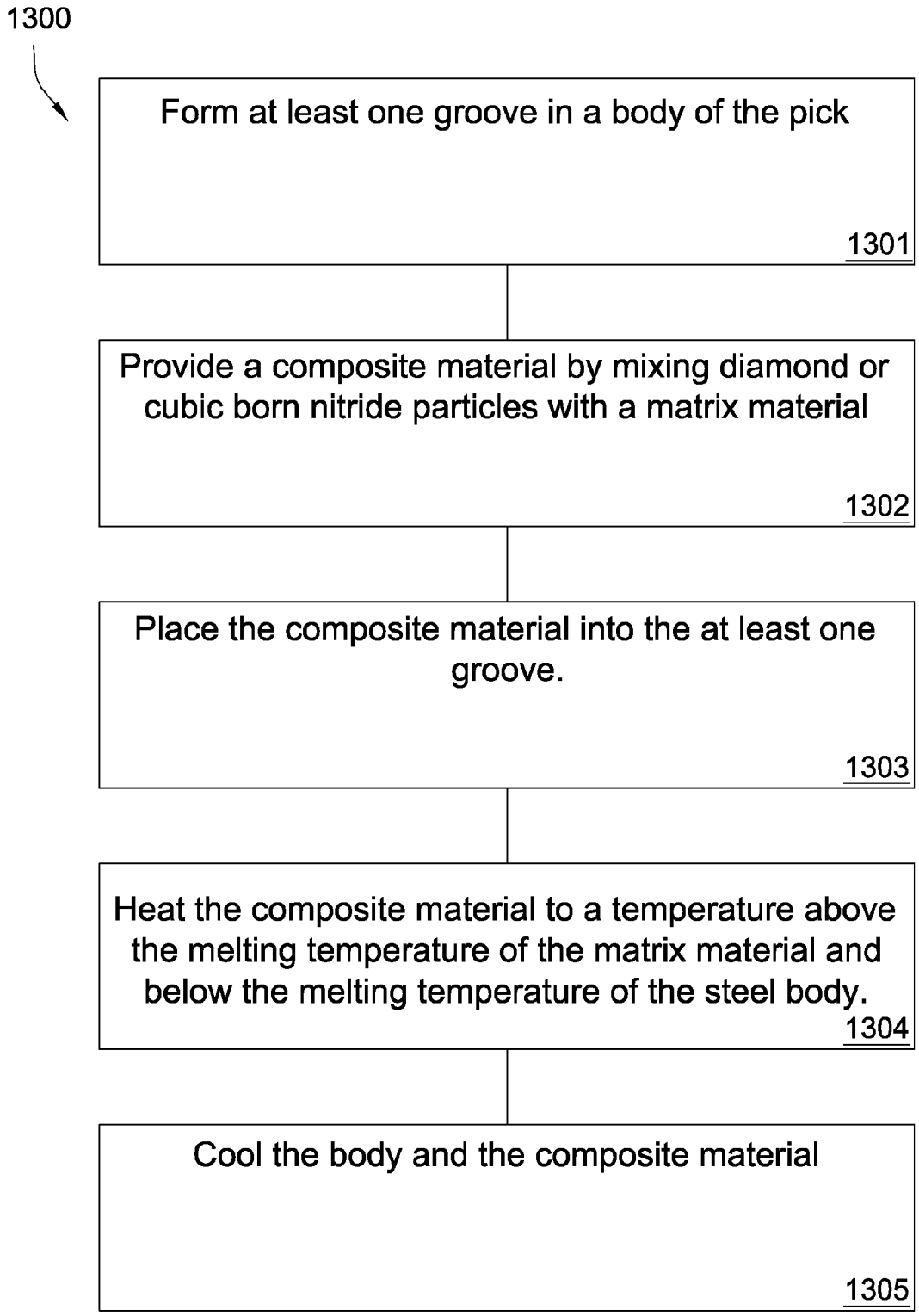
FIG. 13 is a flowchart illustrating an embodiment of a method of depositing a wear resistant composite material onto an outer surface of a steel pick body.

Referring now to FIG. 13, a method 1300 of depositing the wear resistant composite material 208 onto the outer surface 209 of a steel pick body 201 is disclosed in the form of a flowchart. The method 1300 comprises a step 1301 of forming at least one groove 301 in the body 201 of the pick 101, and a step 1302 of providing a composite material 208 by mixing diamond or cubic boron nitride particles with a matrix material. The matrix material may be metal bonded or resin bonded. In step 1303 the composite material is placed into the at least one groove. The method 1300 further comprises a step 1304 of heating the composite material 208 to a temperature above the melting temperature of the matrix material and below the melting temperature of the steel body 201. It is believed that heating the composite material 208 and the body 201 to such a temperature will allow the matrix material to melt and conform to the outer surface 209 of the body 201. In step 1305, the matrix material is believed to solidify as the composite material 208 is cooled. This is believed to help to durably bond the particles into the matrix, and to bond the composite material 208 to the body 201. The method 1300 may further comprise a step of press fitting an impact tip 205 into the steel pick body 201 after the body has cooled, and/or a step 1304 of heating the composite material 208 that uses laser heating.

Whereas the present invention has been described in particular relation to the drawings attached hereto, it should be understood that other and further modifications apart from those shown or suggested herein, may be made within the scope and spirit of the present invention.

What is claimed is:

1. A pick, comprising:

a steel body comprising a formed shank attached to a first end of the body and generally extending along a central axis of the body;

an impact tip secured to a second end of the steel body;

the tip comprising a carbide substrate attached to the second end of the steel body and being bonded to a diamond material;

a composite material fixed within a plurality of annular grooves formed in an outer surface of the steel body and adapted to protect the steel from wear, at least one groove being formed proximate the tip;

the composite material comprising a plurality of diamond particles held within a matrix; and the matrix comprising a diamond particle concentration of 40 to 80 percent by volume.

2. The pick of claim 1, wherein the composite material comprises metal bonded particles.

3. The pick of claim 2, wherein the metal bonded particles are bonded by a metal selected from the group consisting of copper, silicon, indium, silver, nickel, manganese, palladium, zinc, cobalt, titanium, tin, gold, and combinations thereof

4. The pick of claim 1, wherein the composite material comprises resin bonded particles.

5. The pick of claim 4, wherein the resin bonded particles are bonded by a resin selected from the group consisting of polyepoxides, plastics, thermosetting resins, polymers, epoxies, epichlorohydrin, bisphenol A, polyimide, and combinations thereof.

6. The pick of claim 1, wherein the shank is secured within a holder attached to a milling drum connected to the underside of a pavement milling machine.

7. The pick of claim 1, wherein the shank is secured to a bit body adapted for subterranean drilling.

8. The pick of claim 1, wherein the shank is secured to a trenching machine.

9. The pick of claim 1, wherein the shank, carbide substrate and diamond material are generally coaxial.

10. The pick of claim 1, wherein a surface of the composite material is recessed within the at least one groove.

11. The pick of claim 1, wherein a surface of the composite material extends beyond the at least one groove.

12. The pick of claim 1, wherein the composite material is secured within a pattern of grooves, the pattern comprising a conical helix pattern, helical pattern, double helical pattern, annular ring pattern, checkered pattern, zigzag pattern, wavy pattern, segmented pattern, circle pattern, or combinations thereof.

13. The pick of claim 1, wherein the plurality of particles comprises an average particle size of between 1 and 3500 microns.

14. The pick of claim 1, wherein the outer surface of the steel body is textured for improving the bond of the composite material to the steel body.

15. The pick of claim 1, wherein the composite material is press fit into a recess formed in the steel body.

16. A method of depositing a wear resistant composite material onto an outer surface of a steel pick body, comprising:

forming at least one groove in a body of the pick;

providing a composite material by mixing diamond or cubic boron nitride particles with a matrix material, the particles comprising a concentration of 40 to 80 percent by volume;

placing the composite material into the at least one a plurality of annular grooves formed in the outer surface of the body, at least one groove being formed proximate the tip;

heating the composite material to a temperature above the melting temperature of the matrix material and below the melting temperature of the steel; and cooling the body and the composite material.

17. The method of claim 16, further comprising a step of press fitting an impact tip into the steel pick body after the body has cooled.

18. The method of claim 16, wherein the step of heating the composite material comprises laser heating.

* * * * *